US011388961B2

(12) United States Patent
Celant et al.

(10) Patent No.: US 11,388,961 B2
(45) Date of Patent: Jul. 19, 2022

(54) DEVICE FOR ADJUSTING THE LENGTH OF A BRACELET

(71) Applicant: ROLEX SA, Geneva (CH)

(72) Inventors: Benjamin Celant, Cornier (FR); Martin Christian, Eteaux (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 16/963,619

(22) PCT Filed: Feb. 11, 2019

(86) PCT No.: PCT/EP2019/053281
§ 371 (c)(1),
(2) Date: Jul. 21, 2020

(87) PCT Pub. No.: WO2019/158471
PCT Pub. Date: Aug. 22, 2019

(65) Prior Publication Data

US 2021/0059363 A1 Mar. 4, 2021

(30) Foreign Application Priority Data

Feb. 16, 2018 (EP) ..... 18157057

(51) Int. Cl.
*A44C 5/22* (2006.01)
*A44C 5/02* (2006.01)
(Continued)

(52) U.S. Cl.
CPC ..... *A44C 5/02* (2013.01); *A44C 5/0053* (2013.01); *A44C 5/08* (2013.01); *A44C 5/246* (2013.01);
(Continued)

(58) Field of Classification Search
CPC ..... A44C 5/14; A44C 5/02; A44C 5/0053; A44C 5/08; A44C 5/246; Y10T 24/2155; G04B 37/225; G04B 37/0008
See application file for complete search history.

(56) References Cited

U.S. PATENT DOCUMENTS 1,695,487 A * 12/1928 Hadley ..... A44C 5/246 24/71 J
1,985,835 A * 12/1934 Prestinari ..... A44C 5/246 24/71 J
(Continued)

FOREIGN PATENT DOCUMENTS

CN 1651266 A 8/2005
CN 1969707 A 5/2007
(Continued)

OTHER PUBLICATIONS

International Search Report and Written Opinion dated May 7, 2019 in counterpart application No. PCT/EP2019/053281; w/English partial translation and partial machine translation (total 19 pages).
(Continued)

*Primary Examiner* — Jack W Lavinder
(74) *Attorney, Agent, or Firm* — Seckel IP, PLLC

(57) ABSTRACT

The invention relates to a bracelet lengthening device, comprising at least one adjusting assembly (1, 2) that is movable relative to a clasp cover (21), the adjusting assembly (1, 2) and the cover (21) being provided with a first and a second fastening element (23, 35'), respectively, for fastening them respectively in several positions that are able to bring about different bracelet lengths, characterized in that the adjusting assembly (1, 2) and the cover (21) are also provided with a first and a second indexing element (15, 35), respectively.

20 Claims, 5 Drawing Sheets

(51) Int. Cl.

| | |
|---|---|
| ***A44C 5/00*** | (2006.01) |
| ***G04B 37/22*** | (2006.01) |
| ***A44C 5/24*** | (2006.01) |
| ***A44C 5/08*** | (2006.01) |
| *G04B 37/00* | (2006.01) |

(52) U.S. Cl.
CPC ..... *G04B 37/225* (2013.01); *G04B 37/0008* (2013.01)

(56) References Cited

U.S. PATENT DOCUMENTS

| | | | | | |
|---|---|---|---|---|---|
| 1,985,836 | A | * | 12/1934 | Prestinari | A44C 5/246 24/71 J |
| 2,237,931 | A | * | 4/1941 | Haeffner | A44C 5/24 24/71 J |
| 2,240,479 | A | * | 5/1941 | Borden | A44C 5/246 24/71 J |
| 2,444,360 | A | * | 6/1948 | Mauch | A44C 5/246 24/71 J |
| 2,445,023 | A | * | 7/1948 | Ebert | A44C 5/246 24/71 J |
| 2,491,977 | A | * | 12/1949 | Heller | A44C 5/246 24/71 J |
| 2,499,102 | A | * | 2/1950 | Levine | A44C 5/246 24/71 R |
| 2,542,358 | A | * | 2/1951 | Ritter | A44C 5/246 24/71 R |
| 2,555,195 | A | * | 5/1951 | Kostka | A44C 5/246 24/71 J |
| 2,596,186 | A | * | 5/1952 | Volk | A44C 5/246 24/71 J |
| 4,928,359 | A | | 5/1990 | Gagnebin | |
| 5,771,543 | A | | 6/1998 | Froidevaux et al. | |
| 8,001,658 | B2 | | 8/2011 | Christian et al. | |
| 9,198,484 | B2 | | 12/2015 | Knuchel | |
| 2005/0196636 | A1 | | 9/2005 | Kawakami et al. | |
| 2007/0125123 | A1 | | 6/2007 | Sierro | |
| 2008/0083101 | A1 | | 4/2008 | Christian et al. | |
| 2011/0259677 | A1 | | 10/2011 | Dudde et al. | |
| 2012/0184385 | A1 | | 7/2012 | Davis | |
| 2012/0240361 | A1 | | 9/2012 | Léger et al. | |
| 2014/0130545 | A1 | | 5/2014 | Leger | |
| 2014/0223705 | A1 | | 8/2014 | Catanese | |
| 2015/0003217 | A1 | | 1/2015 | Leoni et al. | |
| 2015/0103639 | A1 | | 4/2015 | Portet et al. | |
| 2015/0107299 | A1 | | 4/2015 | Knuchel | |
| 2017/0035156 | A1 | | 2/2017 | Wright et al. | |
| 2018/0059620 | A1 | | 3/2018 | Baebler et al. | |
| 2021/0088976 | A1 | | 3/2021 | Le Loarer | |

FOREIGN PATENT DOCUMENTS

| | | | |
|---|---|---|---|
| CN | 102630145 | A | 8/2012 |
| CN | 103732095 | A | 4/2014 |
| CN | 105029841 | A | 11/2015 |
| EP | 0081616 | A1 | 6/1983 |
| EP | 0350785 | A1 | 1/1990 |
| EP | 0819391 | A1 | 1/1998 |
| EP | 1908366 | A1 | 4/2008 |
| EP | 2749966 | A1 | 7/2014 |
| EP | 2818942 | A1 | 12/2014 |
| EP | 3287855 | A1 | 2/2018 |
| WO | 2013167624 | A1 | 11/2013 |
| WO | 2014114404 | A1 | 7/2014 |

OTHER PUBLICATIONS

European Search Report and Written Opinion dated Jul. 30, 2018 in priority application No. EP18157057; w/English machine translation (total 13 pages).

Chinese Office Action dated Mar. 10, 2022 in counterpart application CN2019800134651; with English translation (total 17 pages) (note: D1, EP0081616, D3, EPapp06405427 published as EP1908366, cited in the Office Action, and D4, US20080083101 cited in the search report of the Office Action, are not listed in this IDS since they are already of record in this application).

Chinese Office Action dated Mar. 11, 2022 in counterpart application CN201910117654.5; with English translation (total 16 pages) [note: D1, CN102630145 and D2, CN1651266 cited in the Office Action, and , and D4, EP2749966 cited in the search Yeport of the Office Action, are not listed in this IDS form since they are already listed in an IDS form filed concurrently).

Office Action dated Apr. 14, 2022 in co-pending U.S. Appl. No. 16/266,449; (total 8 pages) (note: ref.A, U.S. Pat. No. 8,001,658 and ref.B, U.S. Pat. No. 1,985,835 cited in the Office Action are not listed in this IDS since they are already of record in this application).

* cited by examiner

DEVICE FOR ADJUSTING THE LENGTH OF A BRACELET

The present invention relates to a device for adjusting the length of a bracelet, comprising a particular guiding and attachment system for a bracelet, particularly suited to a bracelet for a wristwatch provided with a lengthening device and/or provided with a deployant clasp disposed between two ends of the bracelet. It relates also to a clasp and a bracelet as such, incorporating such a device for adjusting the length of a bracelet, and to a wristwatch as such comprising such a device.

STATE OF THE ART

A deployant clasp of the state of the art, designed to attach the two bands of a watch bracelet around the wrist of its wearer, comprises a number of articulated blades, which can occupy a first, closed position, and a second, open position, in which the blades are no longer attached and allow the insertion or the removal of the bracelet. Such a clasp is generally provided with a first adjustment of its positioning relative to the bracelet, called conventional adjustment. However, the final length obtained is often not optimal.

For that, existing clasps are equipped with a solution that makes it possible to perform a second adjustment of the length of the bracelet, which can also be called comfort adjustment, complementing the first conventional adjustment. The document EP0819391 describes one such solution, which relies on an adjustment link which pivots and can occupy two stable positions inducing two different bracelet lengths. The short position is maintained by a notch of an end link of the bracelet which is attached and elastically locked against the adjustment link in its short position. The document EP1908366 describes another solution in which an adjustment link of the bracelet can be displaced facing a clasp cover of said bracelet, the adjustment link being fixed to the cover by notching. These existing solutions require careful manipulation by a user when adjusting the length of the bracelet, which has to reach a suitable positioning of mobile elements, for example relative to notching, which forms a fastening device whose position varies according to the desired length of the bracelet.

One general aim of the invention is to further improve the ease or usability of the adjustment of the length of a bracelet.

More particularly, the invention proposes a solution for adjusting the length of a bracelet, the operation of which is reliable and the manipulation of which is intuitive and user-friendly.

In addition, the mobile components of a timepiece device, in particular of a device for adjusting the length of a bracelet, are equipped with guiding elements which are subject to numerous constraints, including:

- a mechanical stress in their function of guiding the displacement of a component;
- an exceptional mechanical stress upon a particular event, such as being dropped, an impact, tearing, twisting, etc.;
- environmental stresses such as pollution or the sweat of the user, which could possibly create degradation by rusting or oxidation.

A second objective of the invention is to offer a solution which makes it possible to best address the abovementioned stresses.

Notably, a second object of the invention is to offer a guiding solution for mobile components of a timepiece device, making it possible to limit the wear of the guiding elements, to reduce the frictions thereof, to reduce the risk of seizing and rusting, to limit, even prevent, the deposition and/or the buildup of dirt in the guiding elements.

BRIEF DESCRIPTION OF THE INVENTION

To this end, the invention is based on a bracelet lengthening device, comprising at least one adjustment assembly that is mobile relative to a clasp cover, the adjustment assembly and the cover being respectively provided with a first and a second fastening elements for their respective fastening according to several positions capable of inducing different bracelet lengths, wherein the adjustment assembly and the cover are also provided respectively with a first and a second indexing elements.

The invention is more specifically defined by the claims.

BRIEF DESCRIPTION OF THE FIGURES

These objects, features and advantages of the invention will be explained in detail in the following description of particular embodiments given in a nonlimiting manner in relation to the attached figures in which.

Figure 1:
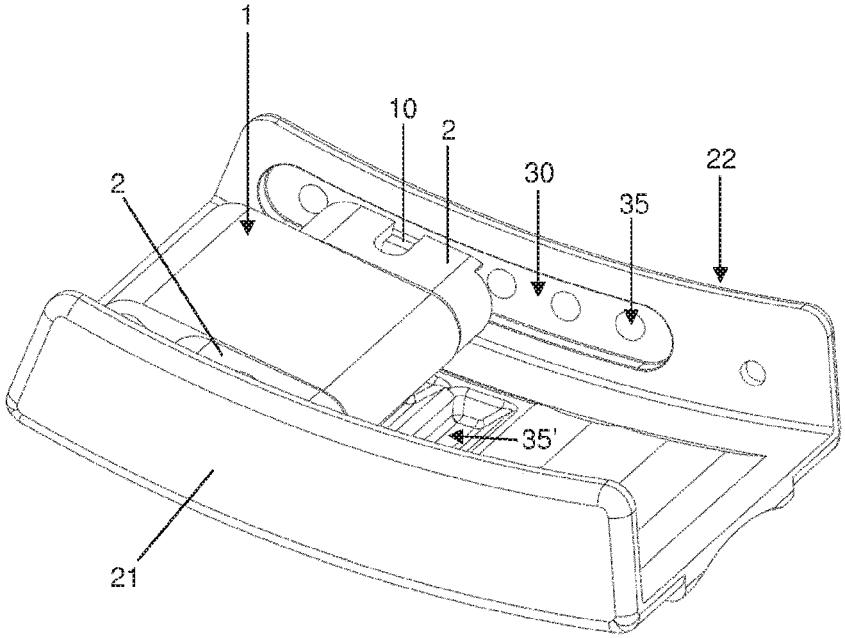
FIG. 1 represents a perspective view of clasp cover incorporating a device for adjusting the length of a bracelet according to an embodiment of the invention.

A device for adjusting the length of a bracelet in a clasp according to an embodiment of the invention will now be described.

Such a device for adjusting the length of a bracelet comprises two lateral lengthening links 2 arranged around a bar 3, and a link 1 mounted to be rotationally mobile about this bar 3. The two lateral lengthening links 2 are mobile relative to a clasp cover 21. This assembly comprising the link 1 and the two lateral links 2 arranged on a bar 3 forms an adjustment assembly of the device for adjusting the length of a bracelet. As a variant, the adjustment assembly can take a form other than that of this embodiment. It can be of a single piece, in a single component, or advantageously comprise an assembly of several components.

The cover 21 comprises two lateral walls 22 each comprising a guideway. Each guideway forms a second guiding element 30, which cooperates with a first guiding element 10 positioned at the ends of the bar 3. Thus, the adjustment assembly also comprises a first guiding element 10.

In this embodiment, the first guiding element 10 advantageously takes the form of a runner or of a roller or of a ball and the second guiding element 30 is in the form of a guideway or of a slide, or of a bore, or of a cutout, or of a groove, conformed to receive such a runner or such a roller or such a ball. The runners or rollers or balls arranged at each end of the bar 3 thus slide parallel, in their respective opposing guideways, by a movement corresponding substantially to a translation.

Figure 3:
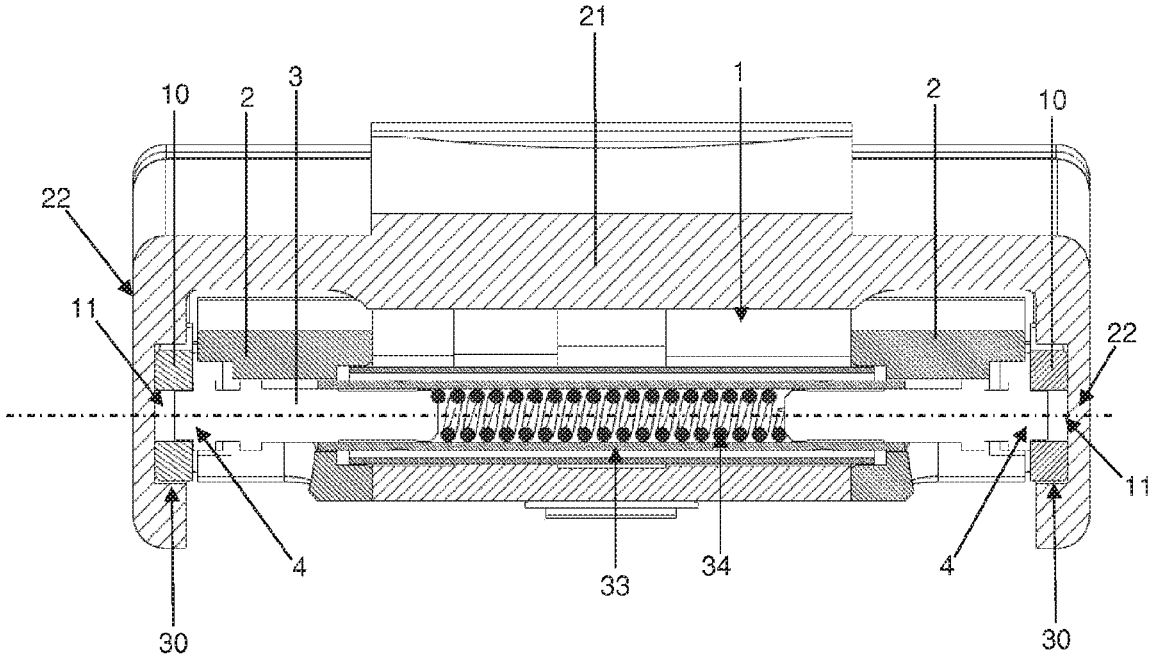
FIG. 3 represents a cross-sectional view along a transverse plane of the clasp cover at the level of the device for adjusting the length of the bracelet according to the embodiment of the invention.
Figure 4:
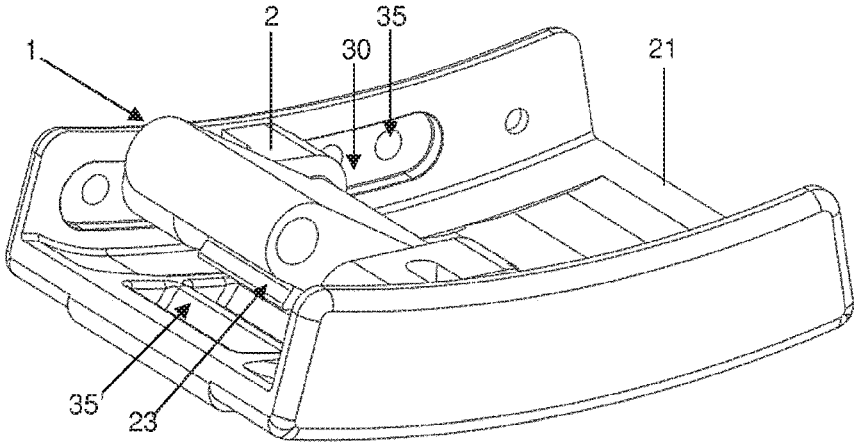
FIG. 4 represents a perspective view of a clasp cover incorporating the device for adjusting the length of a bracelet according to the embodiment of the invention in a phase of manipulation of a link of the adjustment device.

In this embodiment, the first guiding element 10 takes the form of an element distinct from the links 1, 2. In this particular construction, two runners with slightly arced profiles are disposed respectively on either side of the two lateral links 2, and are assembled with these lateral links 2 by the bar 3. To do this, the runners comprise a central bore 11 provided for their positioning around a cylindrical receiving element 4 at the end of the bar 3, as can be seen in particular in FIG. 3.

The bar 3 comprises an annular central part 33 in which there is arranged a spring 34, which exerts an elastic thrust force on the cylindrical receiving elements 4 positioned at the end of the bar 3, and indirectly on the first guiding elements 10, toward the cover 21, and more specifically toward the lateral walls 22 of the cover 21.

In this embodiment, the first guiding elements 10, that is to say the runners or rollers or balls, are of a single piece. Furthermore, they are entirely composed of a high performance polymer, belonging to the family of polyaryletherketones (PAEK), notably of polyetheretherketone (PEEK).

The studies of the applicant have shown that such a polymer notably has the advantage of optimizing the reliability and the durability of the components with a better resistance to wear and abrasion. In particular, the performances in terms of slip and durability are superior, among other things, to those of the polymers from the family of polyacetals.

Alternatively, the first guiding elements 10 could comprise only a portion made of a high performance polymer, belonging to the family of polyaryletherketones (PAEK), notably of PEEK. Notably, this portion could be at the level of a guiding surface, intended to come into contact with the second guiding element 30, that is to say the guideway or the slide. This portion can thus take the form of a surface coating in the contact zones or friction zones. Notably, a conformation in PEEK can be formed around a runner, notably overmolded on a runner. As an example, the first guiding element 10 can comprise a core covered with a coating comprising the polymer material belonging to the PEAK family, forming all or part of the guiding surface.

As another variant, these guiding elements 10 could be made of another material, for example metallic.

Figure 8:
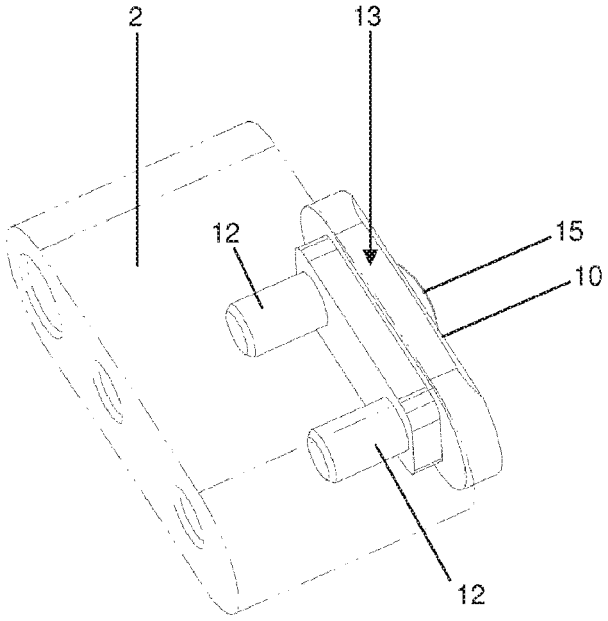
FIG. 8 represents a variant embodiment of a sub-part of the device for adjusting the length of a bracelet according to the embodiment of the invention.

FIG. 8 represents a variant embodiment in which the first guiding element 10 is directly fixed onto a lateral link 2. In this variant, fixing blocks 12 are provided on a lateral face of the first guiding element 10 to be driven into bores of a lateral lengthening link 2. This fastening can, for example, be implemented by driving, riveting, bonding, welding or brazing. The guiding element 10 comprises a guiding surface 13, on its second lateral face.

Alternatively, a lateral link 2 can comprise a protuberance, notably a circular or oblong protuberance, which serves as runner. This protuberance is formed on a side wall of said link 2 and forms the guiding element 10 of the adjustment assembly. In this particular case, the link 2 is of a single piece. It can be made of a high performance polymer, notably of a polymer material belonging to the family of polyaryletherketones (PAEK), in particular of PEEK. Alternatively, the protuberance can be overmolded on a side wall of the lateral link 2. As another alternative, the protuberance can be coated with PEAK, for example PEEK, over all or part of its surface.

Naturally, a guiding element 30 of the cover 21 could also comprise a material belonging to the family of polyaryletherketones (PAEK). In other words, any one of the two guiding elements 10, 30 can wholly or partly comprise a material belonging to the family of polyaryletherketones (PAEK) over all or part of its guiding surface. Alternatively, the two guiding elements can comprise such a material or any other material.

The second guiding element 30 can be made of steel or of precious material, such as gold or platinum. As an alternative, the second guiding element 30 can be made of ceramic. More particularly, it can be made of a single piece with a cover made of ceramic or of steel or of precious material, such as gold or platinum. As mentioned above, the second guiding element 30 can, as a variant, be made of a high performance polymer, notably of a polymer material belonging to the family of polyaryletherketones (PAEK), in particular of PEEK. More particularly, it can be made of a single piece with the cover of the clasp entirely made of PEEK. Alternatively, the second guiding element 30 can be added onto the cover preferentially made of steel or of precious material, such as gold or platinum. As another alternative, the second guiding element 30 can be added onto a cover made of ceramic.

As an example, the clasp cover is provided with slides disposed in the lateral walls formed on either side of said cover. In this particular case, the cover is of a single piece. It can be entirely composed of a high performance polymer, notably of PEEK. Alternatively, the slides only can be coated with a polymer material belonging to the family of polyaryletherketones (PAEK), notably of PEEK, over all or part of their surface. As another alternative, all of the cover can be made of another material, for example a metal.

In the family of polyaryletherketones (PAEK), the chosen material may or may not be filled. A filler makes it possible to optimize, among other things, the tribological and mechanical characteristics of the component. As an example, the filler can comprise at least reinforcing fibers and/or a lubricating agent and/or graphite. As a variant, the filler can also comprise at least one pigment, notably for the purpose of coloring the component.

According to exemplary embodiments, the chosen material will be PEAK, notably PEEK, polyetheretheretherketone (PEEEK), polyetherketone (PEK), polyetherketoneketone (PEKK) or a copolymer of the latter and/or a mix of polymers. Also, this polymer material can advantageously comprise at least one filler of polytetrafluoroethylene (PTFE), of molybdenum sulfide, of tungsten disulfide, of hexagonal boron nitride, of carbon fibers, of aramid fibers, of glass fibers, of graphite, of graphene, of carbon nanotubes, of polyimides, of polyphenylene sulfide, of diamond nanoparticles, of polysilsesquioxanes, of boron fibers or a combination of two or more of the latter. The above list is naturally not limiting.

According to a particular exemplary embodiment, the material is PEEK which contains 20% PTFE, for example Victrex® 450FE20. According to another embodiment, the material is PEEK which contains 30% additive, notably carbon fibers and/or graphite and/or PTFE. According to another embodiment, the material is PEEK which contains 30% carbon fibers and additional additives, notably graphite and/or PTFE. Alternatively or in addition to the carbon fibers, the fibers contained in the PEEK can be aramid fibers or boron fibers. Examples of PEAK or of PEEK that can be used are, among others: Victrex® PEEK 450FC30, Ketron® HPV, Tekapeek® PVX, KetaSpire® KT-820 SL30, AKROTEK® PEAK CF30, AvaSpire® AV-651 CF30, AvaSpire® AV-722 SL30, AvaSpire® AV-755 SL45. It should be noted that, in all cases, and notably in all the embodiments described, the PEEK polymer can be replaced by any other polymer from the PEAK family.

According to a particular exemplary embodiment, the component comprises 65% PEEK, 15% carbon fibers, 10% PTFE, 8% carbon nanotubes and 2% nanodiamond.

The element or the part of the element made of a material belonging to the family of polyaryletherketones (PAEK) is manufactured by any method or combination of methods known to the person skilled in the art. According to a variant embodiment, the surface of the component or of the part of the component made of a material belonging to the family of polyaryletherketones (PAEK) can be structured, in particular micro-structured, notably in order to shape a first element in order to further optimize the tribological and/or wear behavior of the surface made of PEAK or allow a better distribution of a lubricant. This structuring can be obtained directly in the molding of the part or subsequently by machining or micro-machining, for example by laser surface texturing (or LST) or by chemical etching. Any other technique or combination of techniques can also be implemented to obtain a structuring or a micro-structuring.

According to a particular embodiment of the invention, it has been seen that the guiding element or the part of the guiding element which can be a part made of polymer or of metal, is at least partially coated with a coating comprising a material belonging to the family of polyaryletherketones (PAEK), notably PEEK. In such an embodiment, the coating can be applied by using conventional dispersion spraying techniques, electrostatic spraying techniques or overmolding. A coating can also be applied to an element according to one of the preceding embodiments with or without micro-structuring of the surface of said component: for example, a DLC coating or any other appropriate coating technique. A micro-structuring of the surface can also be performed after the application of the coating.

In addition, according to the embodiment, the relative displacement of the link 1 and of the lateral lengthening links 2 relative to the clasp, that is to say of the adjustment assembly relative to the clasp, comprises an indexing device, which makes it possible to predetermine certain relative stable positionings of this adjustment assembly relative to the clasp. Such an indexing device is implemented through indexing elements respectively of the adjustment assembly on the one hand and of the clasp on the other hand.

Figure 2:
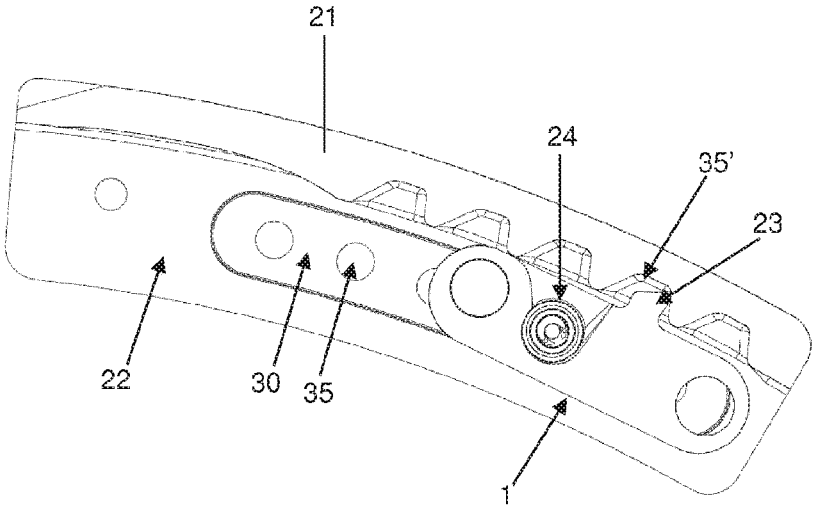
FIG. 2 represents a cross-sectional view along a longitudinal plane of a clasp cover incorporating the device for adjusting the length of a bracelet according to the embodiment of the invention.
Figure 5:
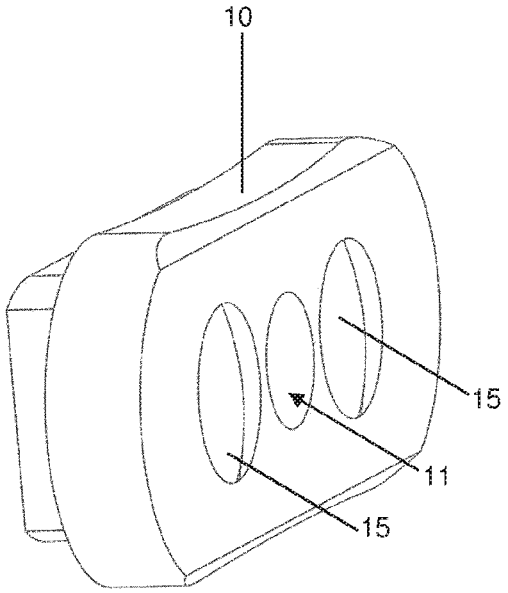
FIG. 5 represents a perspective view of a guiding element of the device for adjusting the length of a bracelet according to the embodiment of the invention.

Thus, according to the embodiment, the first guiding element 10 comprises a first indexing element 15. As an example, FIG. 5 illustrates a guiding element 10 which comprises an indexing element 15 which takes the form of several protuberances directly formed on the guiding element, notably a single-piece runner. These protuberances can have a hemispherical conformation. As an alternative, these protuberances can have any other geometry, such as a rectangular and/or elongate geometry. These protuberances are provided to cooperate with a second indexing element 35 which takes the form of a succession of notches disposed within a guideway forming the second guiding element 30 of a clasp cover, as represented by FIGS. 1 and 2. In this embodiment, the protuberances are made of the material of the first guiding element, for example PEAK, notably PEEK, if the assembly is a single piece. Alternatively, the protuberances can be made of another material, and can notably be formed on a runner of which at least a portion is made of or coated with PEAK.

Figure 6:
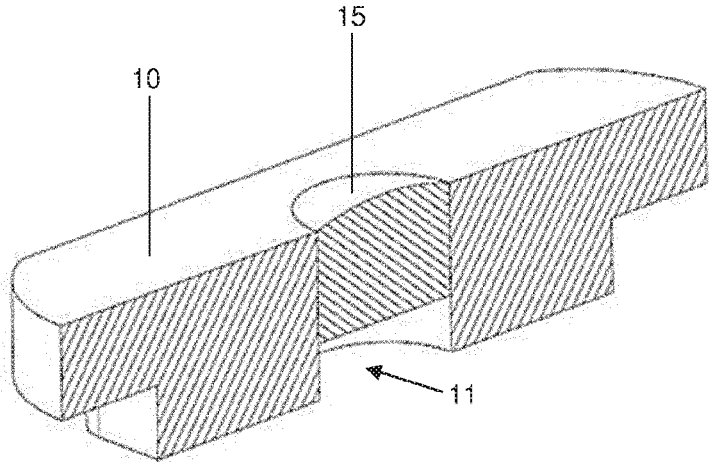
FIG. 6 represents a cross-sectional view of a first variant embodiment of the guiding element of the device for adjusting the length of a bracelet according to the embodiment of the invention.

As an exemplary embodiment, FIG. 6 represents a guiding element 10 in the form of a runner, comprising a cylindrical aperture in which there is mounted an indexing element 15, distinct from the guiding element, advantageously by driving. This cylindrical aperture 11 can be in the extension of that provided for mounting the guiding element at the end of the bar 3, or a distinct aperture.

Figure 7:
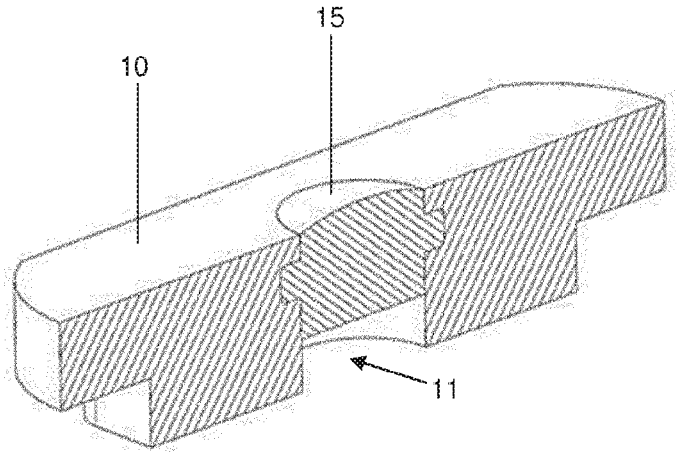
FIG. 7 represents a cross-sectional view of a second variant embodiment of the guiding element of the device for adjusting the length of a bracelet according to the embodiment of the invention.

FIG. 7 illustrates another variant in which a guiding element 10, in runner form, is formed, notably overmolded, around an indexing element 15, distinct from the guiding element. The result thereof is a result similar to that of FIG. 6.

Figure 9:
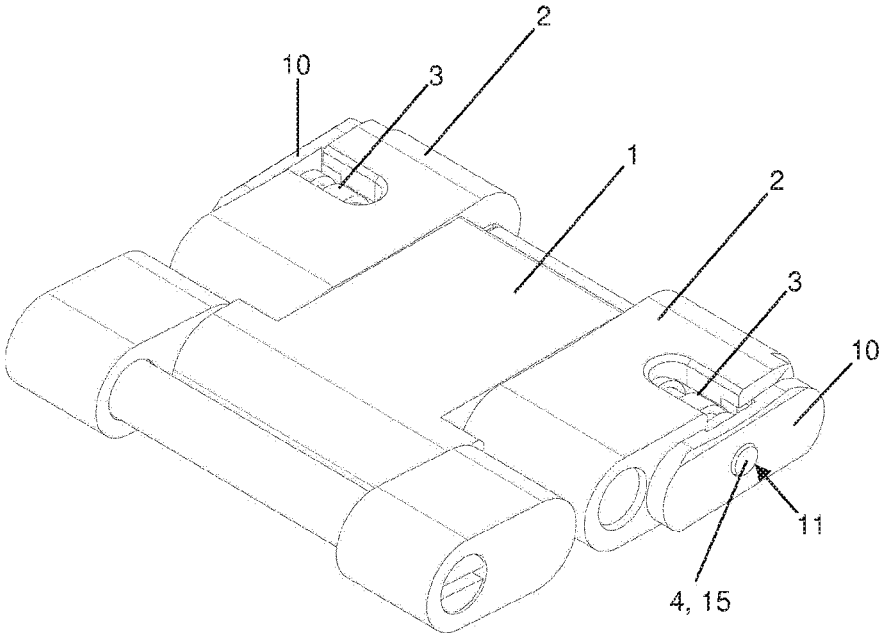
FIG. 9 represents another variant embodiment of a sub-part of the device for adjusting the length of a bracelet according to the embodiment of the invention.

Alternatively, the indexing element 15 can be implemented by a cylindrical receiving element 4 of the bar 3, notably by an end of a cylindrical receiving element 4 of the bar 3, as represented by FIG. 9. For this, the cylindrical receiving element 4 passes right through the guiding element 10, notably through a central bore 11 provided for the positioning of said guiding element, in order to be able to cooperate with the second indexing element 35. Thus, the first indexing element 15 can be distinct from the guiding element 10. In particular, the first indexing element 15 can be implemented by the bar 3.

It should be noted that the indexing device described above can be combined with a complementary indexing device of a bracelet link relative to a clasp cover, that is to say that it can complement a conventional indexing system, such as a bar indexing system or a ball indexing system notably implementing teeth 35' as represented in FIGS. 1 and 2. This conventional indexing device in fact fulfils the function of fastening device, that can be displaced in the longitudinal direction of the clasp, of the adjustment assembly of the device for adjusting the length of the bracelet. Thus, this fastening device that can be displaced can induce different bracelet lengths. This fastening device can thus comprise a tooth 23 arranged on the link 1, subject to a spring 24 exerting a force keeping the tooth 23 against the corresponding teeth 35' of the cover. In this embodiment, the teeth 35' are arranged on the inner face of the top wall of the cover 21, at right angles to the lateral walls 22 which comprise the second guiding devices 30 of the adjustment assembly, as well as the second indexing element 35. The tooth 23 and the teeth 35' form fastening elements of the fastening device, respectively of the adjustment assembly and of the cover. It emerges that, in this embodiment, the second fastening element 35' of the clasp cover 21 and the second indexing element 35 of the clasp cover 21 are arranged on two distinct faces of the cover 21. Any other arrangement could be able to be envisaged, preferably with the second fastening element 35' and the second indexing element 35 arranged in two different zones of the cover.

Thus, the invention relates also to a bracelet lengthening device, comprising a link comprising a first guiding element 10 and a clasp cover 21 comprising a second guiding element 30, the link and the cover being linked to one another movably by a cooperation of their respective guiding elements 10, 30, and wherein the link comprises a first indexing element 15 which cooperates with a second indexing element 35 of the cover 21.

Note that the notching forming a second indexing element complements the notching known from the state of the art, for example the notching 35' that is particularly visible in FIG. 2, forming a fastening device. The indexing device can thus form a pre-positioning element, which assists the user in an adjustment by allowing a suitable position of the adjustment assembly, notably to act appropriately on the fastening device. This indexing device is not sufficient for the fastening of the adjustment assembly, which can easily escape from the different notches to allow adjustment. It does not fulfil a fastening function. It complements a distinct fastening device, as described previously.

An indexing element can form a single-piece assembly with a guiding element, or a distinct element, arranged in proximity to or through a guiding element. The indexing element can, moreover, take the form of an assembly, such as a ball ratchet comprising a ball elastically returned by a spring, the latter notably being able to complement or replace the spring 34 of the bar 3 which is more particularly visible in FIG. 3.

Note that, according to the embodiment, the spring 34 cooperates with the first indexing element 15 so as to exert an elastic thrust force on the first indexing element 15 toward a second indexing element 35 and to allow the releasing of the first and second indexing elements 15, 35 in a phase of adjustment of the length of said bracelet.

It appears that these indexing elements are subject to stresses very similar to those to which the guiding elements are subject. Thus, they can also advantageously comprise a polymer material belonging to the family of polyaryletherketones (PAEK). In addition or alternatively, they can comprise other materials.

As a variant, the first indexing element 15 can be implemented independently of the first guiding element 10.

Thus, the invention also relates to a bracelet lengthening device, comprising at least one link linked to a clasp cover, the link comprising a first indexing element 15 and the cover 21 of the clasp comprising a second indexing element 35, the two components being linked to one another movably, and wherein the first indexing element 15 and/or the second indexing element 35 comprises a contact surface, comprising a polymer material belonging to the family of polyaryletherketones (PAEK).

When adjusting the length of the bracelet, a user proceeds to rotate the link 1 of the adjustment assembly, in order to release the tooth 23 from a notch of the notching 35' of the clasp, thus opening the fastening device of the adjustment assembly. This action can be performed by pulling on a bracelet link in an appropriate direction. The adjustment assembly thus reaches an open position allowing it to be displaced longitudinally relative to the clasp, via guiding elements 10, 30 explained previously. In this displacement, the adjustment assembly is automatically positioned in succession in the different stable positions predefined by the indexing elements. These indexing elements are advantageously distributed by a pitch equal to the pitch of the fastening device, and correspondingly, such that each indexing element corresponds to a fastening position. In this way, the adjustment assembly is automatically positioned in the positions previously defined by the indexing elements in its longitudinal displacement, under the effect of an elastic element of the adjustment assembly, which thus facilitates the positioning of the adjustment assembly at the different possible longitudinal locations, corresponding to different authorized length settings. The adjustment of the length of a bracelet thus becomes assisted and very user-friendly. If the user wants to continue the adjustment, he or she continues the displacement of the adjustment assembly, and the force he or she exerts allows disengagement from the intermediate indexing elements encountered, against the force of the elastic element of the adjustment assembly.

The invention relates also to a bracelet and/or a clasp and/or a wristwatch, which incorporate(s) a bracelet lengthening device as described previously.

The invention claimed is:

1. A bracelet lengthening device, comprising at least one adjustment assembly that is mobile relative to a clasp cover, wherein the adjustment assembly and the clasp cover are respectively provided with a first and a second fastening elements for respective fastening of the adjustment assembly and the clasp cover according to several positions capable of inducing different bracelet lengths, and wherein the adjustment assembly and the clasp cover are also respectively provided with a first and a second indexing elements, wherein the indexing elements provide distinct locations corresponding to the several positions suitable for the fastening of the fastening elements.

2. The bracelet lengthening device as claimed in claim 1, wherein the adjustment assembly comprises a first guiding element and the clasp cover comprises a second guiding element, the adjustment assembly and the clasp cover being linked to one another movably by a cooperation of the respective first and second guiding elements, and wherein the first indexing element is arranged on the first guiding element.

3. The bracelet lengthening device as claimed in claim 2, wherein the first guiding element and the first indexing element form a single-piece assembly.

4. The bracelet lengthening device as claimed in claim 2, wherein the first indexing element is distinct from the first guiding element.

5. The bracelet lengthening device as claimed in claim 4, wherein the first indexing element is made in a material other than a material of the first guiding element, or wherein the first indexing element has a coating in a material other than a material of a coating of the first guiding element.

6. The bracelet lengthening device as claimed in claim 4, wherein the first indexing element is added onto the first guiding element by driving or overmolding, or wherein the first indexing element is formed at an end of a cylindrical receiving element positioned at an end of a bar of the adjustment assembly.

7. The bracelet lengthening device as claimed in claim 2, wherein the adjustment assembly and the first guiding element are two distinct elements, or wherein the adjustment assembly comprises at least one link, the first guiding element forming a single-piece assembly with the link.

8. The bracelet lengthening device as claimed in claim 1, wherein the adjustment assembly comprises a spring cooperating with the first indexing element so as to exert an elastic thrust force on the first indexing element toward the second indexing element and to allow the releasing of the first and second indexing elements in a phase of adjustment of the length of said bracelet.

9. The bracelet lengthening device as claimed in claim 8, wherein the adjustment assembly comprises a bar, at least one selected from the group consisting of a first guiding element and the first indexing element being arranged at the end of the bar, and wherein the spring is arranged in the bar so as to exert an elastic thrust force on at least one selected from the group consisting of the first guiding element and the first indexing element toward the cover.

10. The bracelet lengthening device as claimed in claim 1, wherein the first indexing element and the second indexing element respectively take the form of at least one protuberance and at least one hollow or notch, or, conversely, of at least one hollow or notch and at least one protuberance.

11. The bracelet lengthening device as claimed in claim 1, wherein the first and second fastening elements on one side take the form of a tooth arranged on a link of the adjustment assembly, and on the other side take the form of teeth arranged on an inner surface of the cover of the clasp.

12. The bracelet lengthening device as claimed in claim 1, wherein the second fastening element of the clasp cover and the second indexing element of the clasp cover are arranged on two different zones of the cover.

13. The bracelet lengthening device as claimed in claim 12, wherein the second fastening element of the clasp cover and the second indexing element of the clasp cover are arranged on two distinct or non-aligned faces of the cover.

14. The bracelet lengthening device as claimed in claim 1, wherein the adjustment assembly comprises a first guiding element and the clasp cover comprises a second guiding element, the adjustment assembly and the cover being linked to one another movably by a cooperation of their respective guiding elements, wherein at least one selected from the group consisting of (i) the first guiding element comprises a guiding surface at least partially in contact with the second guiding element, the guiding surface comprising a polymer material belonging to the family of polyaryletherketones (PAEK), and (ii) at least one selected from the group consisting of the first indexing element, the second indexing element, and the second guiding element comprise a polymer material belonging to the family of polyaryletherketones (PAEK).

15. The bracelet lengthening device as claimed in claim 14, wherein the respective first and second guiding elements of the adjustment assembly and of the cover allow a relative sliding of the first and second guiding elements.

16. The bracelet lengthening device as claimed in claim 15, wherein the first guiding element has a shape of a roller or a runner or a ball, cooperating with the second guiding element which has a shape of a slide, a guideway, a cutout, a bore or a groove.

17. The bracelet lengthening device as claimed in claim 16, wherein the indexing elements are distributed according to a pitch equal to the pitch of the fastening device, and correspondingly, so that each position defined by the indexing elements has a corresponding fastening position of the fastening device.

18. A deployant clasp for a bracelet, wherein the deployant clasp comprises a bracelet lengthening device as claimed in claim 1.

19. A bracelet, wherein the bracelet comprises a deployant clasp as claimed in claim 18.

20. A timepiece, wherein the timepiece comprises a bracelet lengthening device as claimed in claim 1.

* * * * *